US007108342B2

(12) United States Patent
Shin et al.

(10) Patent No.: US 7,108,342 B2
(45) Date of Patent: Sep. 19, 2006

(54) REFRIGERATOR HOME BAR UNIT DOOR

(75) Inventors: Dong-In Shin, Kwangju (KR); Jae-sek Oh, Kwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 209 days.

(21) Appl. No.: 10/244,660

(22) Filed: Sep. 17, 2002

(65) Prior Publication Data

US 2003/0132690 A1 Jul. 17, 2003

(30) Foreign Application Priority Data

Jan. 15, 2002 (KR) ..... 2002-2345

(51) Int. Cl.
*A47B 96/00* (2006.01)

(52) U.S. Cl. ..... 312/405; 312/404; 62/265

(58) Field of Classification Search ..... 312/401, 312/402, 404, 405, 291, 292; 62/265
See application file for complete search history.

(56) References Cited

U.S. PATENT DOCUMENTS

| | | | | |
|---|---|---|---|---|
| 2,124,857 A | | 7/1938 | MacGrath | |
| 3,218,111 A | * | 11/1965 | Steiner | 312/405.1 |
| 4,087,143 A | | 5/1978 | Barnard et al. | |
| 4,586,347 A | * | 5/1986 | McCarty | 62/265 |
| 4,790,146 A | * | 12/1988 | Mun et al. | 62/441 |
| 5,209,082 A | | 5/1993 | Ha | |
| 6,055,823 A | * | 5/2000 | Baker et al. | 62/265 |

FOREIGN PATENT DOCUMENTS

| | | |
|---|---|---|
| EP | 0 351 573 | 6/1989 |
| JP | 50-136056 | 11/1975 |
| JP | 5-288459 | 11/1983 |
| JP | 58-74086 | 5/1993 |
| JP | 2001-500605 | 1/2001 |
| JP | 2001-303842 | 10/2001 |
| KR | 1999-8691 | 3/1999 |
| KR | 1999-29399 | 7/1999 |
| KR | 1999-31097 | 7/1999 |
| WO | 99/01704 | 1/1999 |

* cited by examiner

*Primary Examiner*—James O. Hansen
(74) *Attorney, Agent, or Firm*—Staas & Halsey LLP

(57) ABSTRACT

A refrigerator having a door to open and close a refrigerator compartment, a home bar unit provided on the door and having an opening through which the refrigerator compartment communicates externally thereof, and a home bar unit door to open and close the opening of the home bar unit. The home bar unit door has a support bracket connected to the opening of the home bar unit, a movable bracket connected to the home bar unit door that rotates together with the home bar unit door, and a stopper unit including a first stopper provided at the movable bracket that rotates together with the movable bracket, and a second stopper provided at the support bracket that restricts the rotation of the home bar unit door when the home bar unit door is positioned at an open position thereof. With this configuration, the present invention provides a refrigerator in which opposite sides of a home bar unit door are not blocked by any links when the home bar unit door is opened, and also provides an appearance that is tidy.

13 Claims, 7 Drawing Sheets

REFRIGERATOR HOME BAR UNIT DOOR

CROSS-REFERENCE TO RELATED APPLICATIONS

This application claims the benefit of Korean Application No. 2002-2345, filed Jan. 15, 2002, in the Korean Industrial Property Office, the disclosure of which is incorporated herein by reference.

BACKGROUND OF THE INVENTION

1. Field of the Invention

The present invention relates in general to a refrigerator, and more particularly, to a refrigerator improved in a rotation structure of a home bar unit.

2. Description of the Related Art

A side-by-side refrigerator having a relatively large storage capacity, as illustrated in FIGS. 6 and 7, comprises of a cabinet 110 forming a freezer compartment and a refrigerator compartment, and a freezer compartment door 112 and a refrigerator compartment door 114 provided in front of the cabinet 110 to open and close the freezer and refrigerator compartments, respectively.

In the refrigerator compartment door 114 is provided a home bar unit 120 to put food into the refrigerator compartment and to take out food therefrom without opening the refrigerator compartment door 114. In front of an opening 120*a* of the home bar unit 120 is provided a home bar unit door 130 to open and close the opening 120*a*. Herein, the home bar unit door 130 is disposed horizontally when it is opened, so that it can be employed as a shelf on which food taken out of the refrigerator compartment is put.

As illustrated in FIG. 6, a hinge part, allowing the home bar unit door 130 to rotatably open and close the opening 120*a*, may comprise a pair of links 140 and 141. The links 140 and 141 each have one end linked to each other, and the end 140*a* and 141*a* connected to a side of the home bar unit door 130 and the side wall of the opening 120*a* of the home bar unit 120, respectively. Thus, the links 140 and 141 cooperate so that the home bar door unit 130 rotatably opens and closes the opening 120*a*.

Contrary to the hinge part illustrated in FIG. 6, a hinge part may, as illustrated in FIG. 7, comprise a pair of links 150. Each link 150 has one end 150*a* movably inserted into an elongated hole 151 provided on a side wall of the opening 120*a* of the home bar unit 120, and the other end 150*b* connected to the side of the home bar door unit 130. Thus, the one end 150*a* moves within the elongated hole 151 so that the home bar unit door 130 rotatably opens and closes the opening 120*a*.

However, in the conventional refrigerator, because the links are employed in the hinge part of the home bar unit door, opposite sides of the home bar unit door employed as a shelf are blocked by the links.

Further, because the links are exposed externally when the home bar unit door is opened, the appearance thereof is untidy.

SUMMARY OF THE INVENTION

Accordingly, it is an object of the present invention to provide a refrigerator in which opposite sides of a home bar unit door are not blocked by any links when the home bar unit door is opened, and the appearance thereof is tidy.

Additional objects and advantages of the invention will be set forth in part in the description which follows and, in part, will be obvious from the description, or may be learned by practice of the invention.

The foregoing and other objects of the present invention may be achieved by providing a refrigerator comprising: a door opening and closing a refrigerator compartment; a home bar unit provided on the door and having an opening through which the refrigerator compartment communicates externally thereof; and a home bar unit door opening and closing the opening of the home bar unit. The home bar unit door comprises: a support bracket connected to the opening of the home bar unit; a movable bracket connected to the home bar unit door and rotating together with the home bar unit door; and a stopper unit including a first stopper provided at the movable bracket and rotating together with the movable bracket, and a second stopper provided at the support bracket and restricting the rotation of the home bar unit door when the home bar unit door is positioned at an open position thereof.

In one aspect of the invention, the movable bracket comprises: a pair of first brackets spaced from each other at a predetermined distance and connected to the rear of the home bar unit door, and a second bracket connecting the first brackets, the first stopper being connected to the second bracket.

In another aspect of the invention, the first stopper comprises: a first extension part extending from the second bracket, and a second extension part downwardly bending from the first extension part.

In yet another aspect of the invention, the home bar unit door comprises a pair of hinge pins at lower opposite sides thereof, and the movable bracket comprises a first flange having a first hinge hole rotatably connected to one of said pair of hinge pins.

In yet another aspect of the invention, the support bracket comprises: a pair of third brackets connected to the rear opposite sides of the opening of the home bar unit; and a fourth bracket connecting the third brackets; the fourth bracket having a second stopper connected thereto.

In yet another aspect of the invention, the second stopper comprises: a horizontal extension part extending from the fourth bracket and contacting the first stopper when the home bar unit door is opened; and a vertical extension part downwardly bending from the horizontal extension part and buried within a wall of the opening of the home bar unit.

In yet another aspect of the invention, the support bracket further comprises: a second flange having a second hinge hole therein in cooperation with the first hinge hole and rotatably connected to the hinge pin.

In yet another aspect of the present invention, on a top wall of the opening of the home bar unit is provided a hook holder, and the home bar unit door is provided with a lever unit hooked to the hook holder when the home bar unit door is closed.

In yet another aspect of the present invention, the lever unit comprises: a lever rotatably connected to a lever accommodating part provided on the home bar unit door; and a hook extending therefrom and being hooked to and released from the hook holder.

BRIEF DESCRIPTION OF THE DRAWINGS

These and other objects and advantages of the invention will become apparent and more readily appreciated from the following description of the embodiments, taken in conjunction with the accompanying drawings of which.

DETAILED DESCRIPTION OF THE EMBODIMENTS

Figure 1:
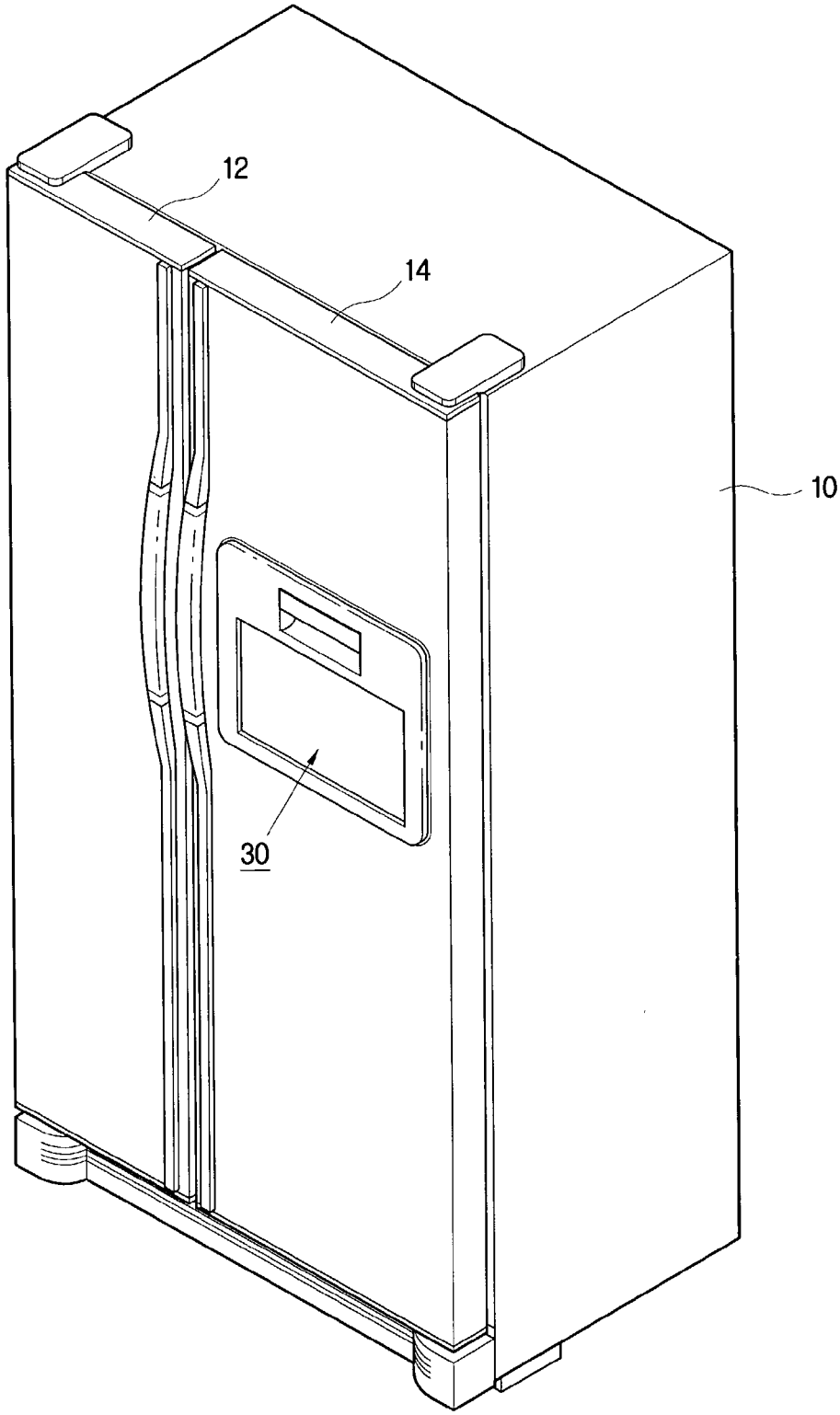
FIG. 1 is a perspective view of a refrigerator provided with a home bar unit according to an embodiment of the present invention.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 2:
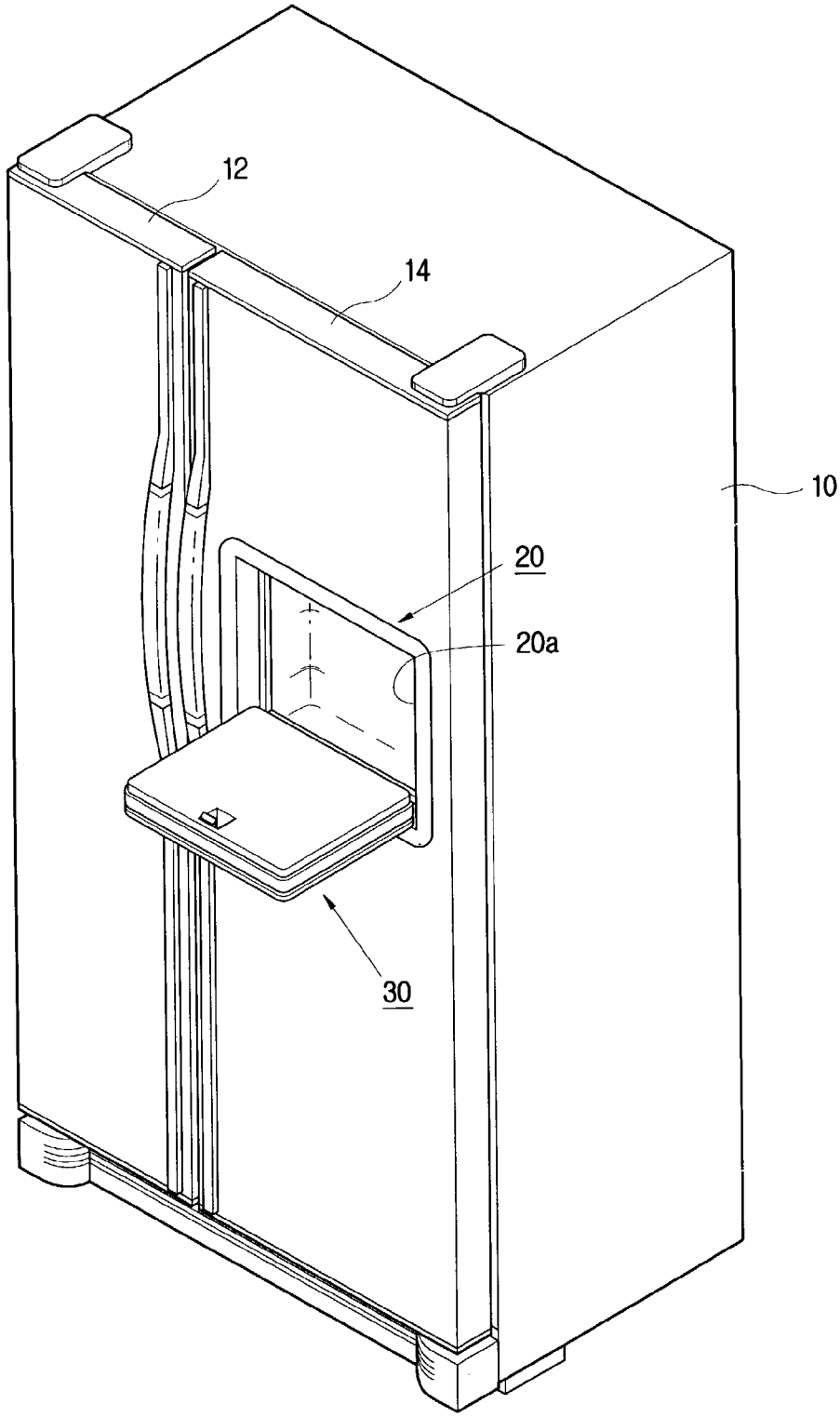
FIG. 2 is a perspective view of the refrigerator in a state wherein the home bar unit of FIG. 1 is opened.

A refrigerator according to an embodiment of the present invention, as illustrated in FIGS. 1 and 2, comprises a cabinet 10 forming a freezer compartment (not shown) and a refrigerator compartment 15 (refer to FIGS. 4 and 5), and a freezer compartment door 12 and a refrigerator compartment door 14 provided in front of the cabinet 10 to open and close the freezer compartment and refrigerator compartment 15, respectively.

In the refrigerator compartment door 14 is provided a home bar 20 through which the inside of the refrigerator compartment 15 communicates externally thereof to put food into the refrigerator compartment 15 and to take food therefrom without opening the refrigerator compartment door 14. In front of an opening 20*a* of the home bar unit 20 is provided a home bar unit door 30 rotating between an open position of the opening 20*a* and a closed position of the opening 20*a*. Herein, the home bar unit door 30 is disposed horizontally when it is opened, so that it can be employed as a shelf on which food taken out of the refrigerator compartment 15 is put.

Figure 3:
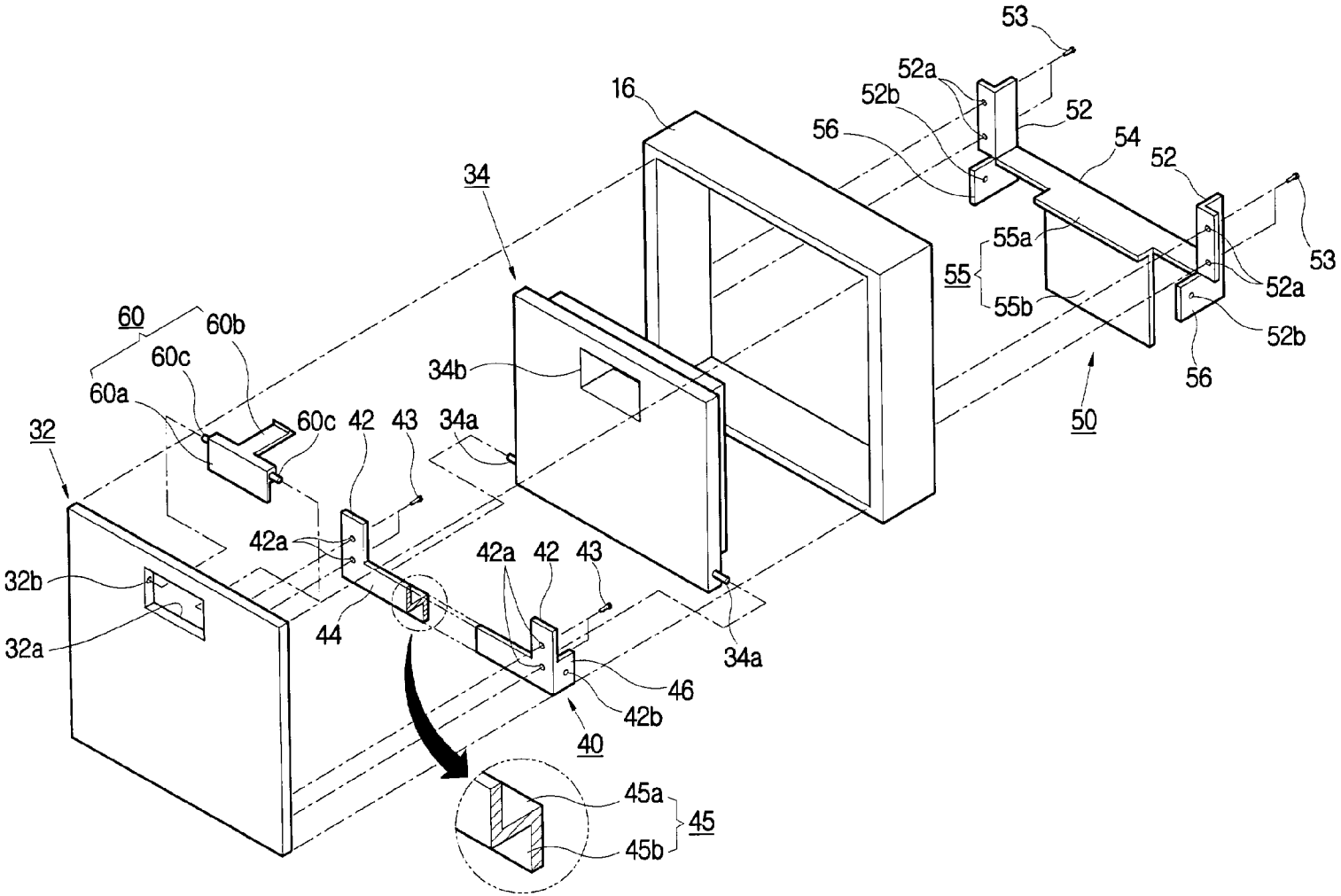
FIG. 3 is an exploded perspective view illustrating the home bar unit of FIG. 1 and its vicinity.

As illustrated in FIG. 3, a supporting frame 16 is connected to the opening 20*a* of the home bar unit 20, which is connected to a support bracket 50, and the home bar unit door 30 is connected to a movable bracket 40. Further, in the movable brackets 40 and 50 are provided first and second stoppers 45 and 55, respectively. The first stopper 45 contacts the second stopper 55 when the home bar unit door 30 is opened (refer to FIG. 5).

The home bar unit door 30 comprises a front cover 32 forming an outer appearance, and a rear cover 34 connected to the rear of the front cover 32 and employed as a shelf on which food is put. Herein, the home bar unit door 30 may further comprise an outer frame (not shown) surrounding the circumference of the front cover 32.

The movable bracket 40 is connected to the rear of the front cover 32, rotating between the open position and the closed position together with the home bar unit door 30. The movable bracket 40 comprises a pair of first brackets 42 spaced from each other by a predetermined distance and vertically connected to the rear opposite sides of the front cover 32, respectively, and a second bracket 44 connecting the pair of first brackets 42 and horizontally connected to the rear lower part of the front cover 32.

On the first bracket 42 is provided a plurality of through holes 42*a*, and on the rear of the front cover 32 is provided a plurality of screw holes (not shown) corresponding to the through holes 42*a* of the first bracket 42. Thus, the movable bracket 40 is fastened to the rear of the front cover 32 by inserting screws 43 into the screw holes through the through holes 42*a*.

In the second bracket 44 is provided the first stopper 45 extending therefrom. The first stopper 45 comprises a first extension part 45*a* perpendicularly extending from the second bracket 44, and a second extension part 45*b* downwardly bending from the first extension part 45*a*. The second extension part 45*b* of the first stopper 45 contacts a horizontal extension part 55*a* of the second stopper 55 when the home bar unit door 30 is opened (refer to FIG. 5), thereby leaving the home bar unit door 30 in a horizontal and open position. Herein, the first bracket 42, the second bracket 44, and the first stopper 45 may be made of one material as one body. Further, only the first stopper 45 may be provided in the front cover 32 without the movable bracket 40, but it is desirable that the first stopper 45 is reinforced with the movable bracket 40. Additionally, the first stopper 45 may be provided on the rear cover 34.

At opposite sides of the lower part of the rear cover 34 are provided a pair of hinge pins 34*a*. Corresponding to the pair of the hinge pins 34*a*, on opposite sides of the first brackets 42 of the movable bracket 40 are provided a pair of first flanges 46 each having a first hinge hole 42*b*. The first hinge hole 42*b*, together with a second hinge hole 52*b* provided on a second flange 56 of the support bracket 50, accommodates the hinge pin 34*a* therein. Thus, the home bar unit door 30 rotates on the axis of the hinge pin 34*a*.

In order to make the home bar unit door 30 rotating on the axis of the hinge pin 34*a* become locked to or released from the opening 20*a* of the home bar unit 20, a lever unit 60 is provided between the home bar unit door 30 and the supporting frame 16 provided in the opening 20*a* of the home bar unit 20.

The lever unit 60 comprises a lever 60*a* connected with a pair of hinge pins 60*c* and accommodated in a lever accommodating part 32*a* provided on the front cover 32, and a hook 60*b* extending from the upper part of the lever 60*a* and hooking to a hook holder 16*a* of the supporting frame 16 provided in the opening 20*a* of the home bar unit 20 through a lever through hole 34*b* provided on the rear cover 34.

On opposite sides inside the lever accommodating part 32*a*, provided at the upper part of the front cover 32, is a pair of hinge holes 32*b* to accommodate the pair of lever hinge pins 60*c* connected to the lever 60*a* of the lever unit 60.

The hook 60*b* is hooked to and released from the hook holder 16*a* of the supporting frame 16. Thus, the hook 60*b* of the lever unit 60 hooks to the hook holder 16*a* while the home bar door 30 is closed, and is released from the hook holder 16*a* when the lever 60*a* is pulled to open the home bar unit door 30.

On the other hand, the support bracket 50 comprises a pair of third brackets 52 connected to the rear opposite sides of the supporting frame 16, a fourth bracket 54 connecting the pair of third brackets 52 at the lower part thereof, and the pair of second flanges 56 each downwardly extending from the pair of third brackets 52.

The third bracket 52 is provided with a plurality of through holes 52*a*, and the supporting frame 16 is provided with a plurality of screw holes (not shown) corresponding to the plurality of through holes 52*a*. Thus, the support bracket 50 is fastened to the supporting frame 16 by inserting screws 53 into the screw holes through the through holes 52*a*.

The second flange 56 is provided with the second hinge hole 52*b* accommodating the hinge pin 34*a* therein, in cooperation with the first hinge hole 42*b* provided on the first flange 46 of the movable bracket 40.

Figure 4:
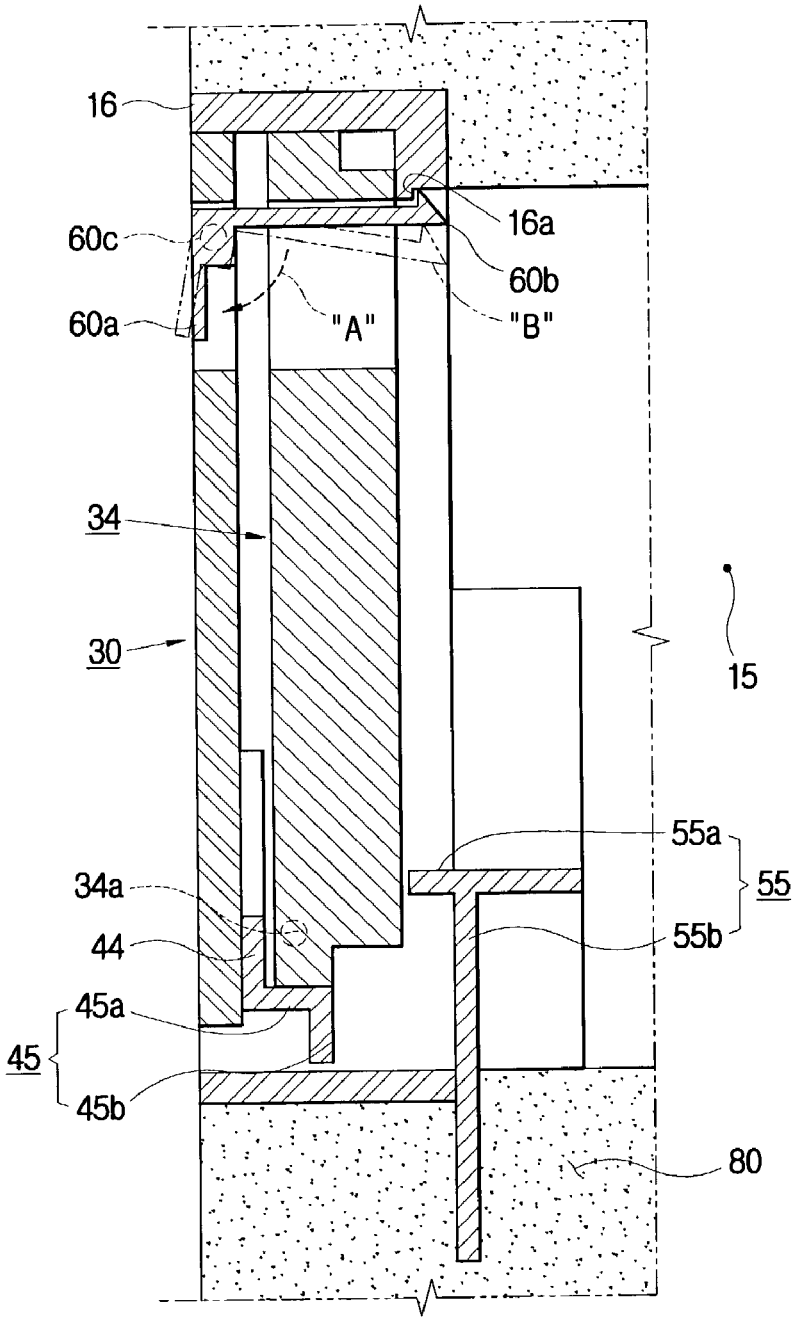
FIGS. 4 and 5 are each sectional views illustrating operations of the home bar door unit of FIG. 3.
Figure 5:
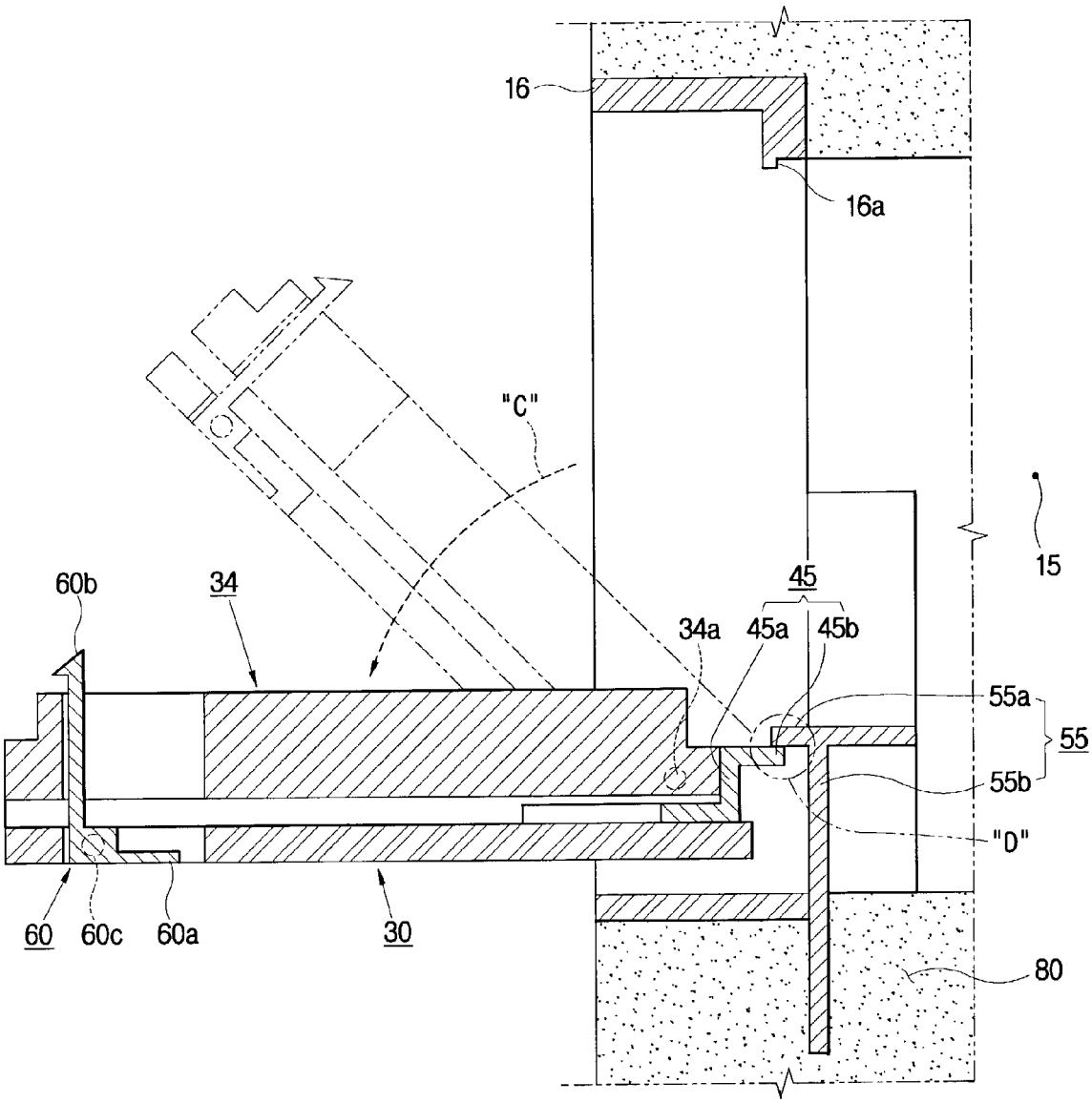

In the middle of the fourth bracket 54 is provided the second stopper 55 extending therefrom. The second stopper 55 comprises a horizontal extension part 55*a* with which the second extension part 45*b* of the first stopper 45 contacts when the home bar unit door 30 is opened, and a vertical extension part 55*b* downwardly extending from the horizontal extension part 55*a* and buried within a bottom wall of the opening 20*a* of the home bar unit 20. Herein, the vertical extension part 55*b* is employed to reinforce the second stopper 55. As illustrated in FIGS. 4 and 5, it is effective that the vertical extension part 55*b* is relatively long. Then, the vertical extension part 55*b* is disposed inside the refrigerator compartment door 12, and fixed by a foaming agent 80 filled within the refrigerator door 12. Further, only the second stopper 55 may be provided in the supporting frame 16 without the support bracket 50, but it is desirable that the second stopper 55 is reinforced with the support bracket 50.

With this configuration, the rotation of the home bar unit door 30 between the open position and the closed position will be described herein below.

FIG. 4 illustrates the home bar unit door 30 positioned at the closed position. In this state, the second extension part 45*b* of the first stopper 45, provided in the movable bracket 40, is spaced from the horizontal extension part 55*a* of the second stopper 55. Further, the hook 60*b* of the lever unit 60 is hooked to the hook holder 16*a* of the supporting frame 16 provided in the opening 20*a* of the home bar unit 20.

To rotate the home bar unit door 30 to the open position, when the lever 60*a* of the lever unit 60 exposed to the outside of the home bar unit door 30 is pulled in a direction of an arrow "A" in FIG. 4, the hook 60*b* of the lever unit 60 releases from the hook holder 16*a* (see "B" in FIG. 4). Then, the home bar unit door 30 rotates by its own weight on the axis of the pair of hinge pins 34*a* provided at the lower part of the home bar unit door 30 (see "C" in FIG. 5).

When the home bar unit door 30 is horizontally opened, the second extension part 45*b* of the first stopper 45, provided in the movable bracket 40 rotating together with the home bar unit door 30, contacts the horizontal extension part 55*a* of the second stopper 55 provided in the support bracket 50, thereby stopping its rotation (see "D" in FIG. 5). Therefore, the home bar unit door 30 is stopped at the open position. In this state, a user can put food into the refrigerator compartment 15 or take food therefrom through the opening 20*a* of the home bar unit 20, or use the inside surface of the home bar unit door 30 as a shelf.

Figure 6:
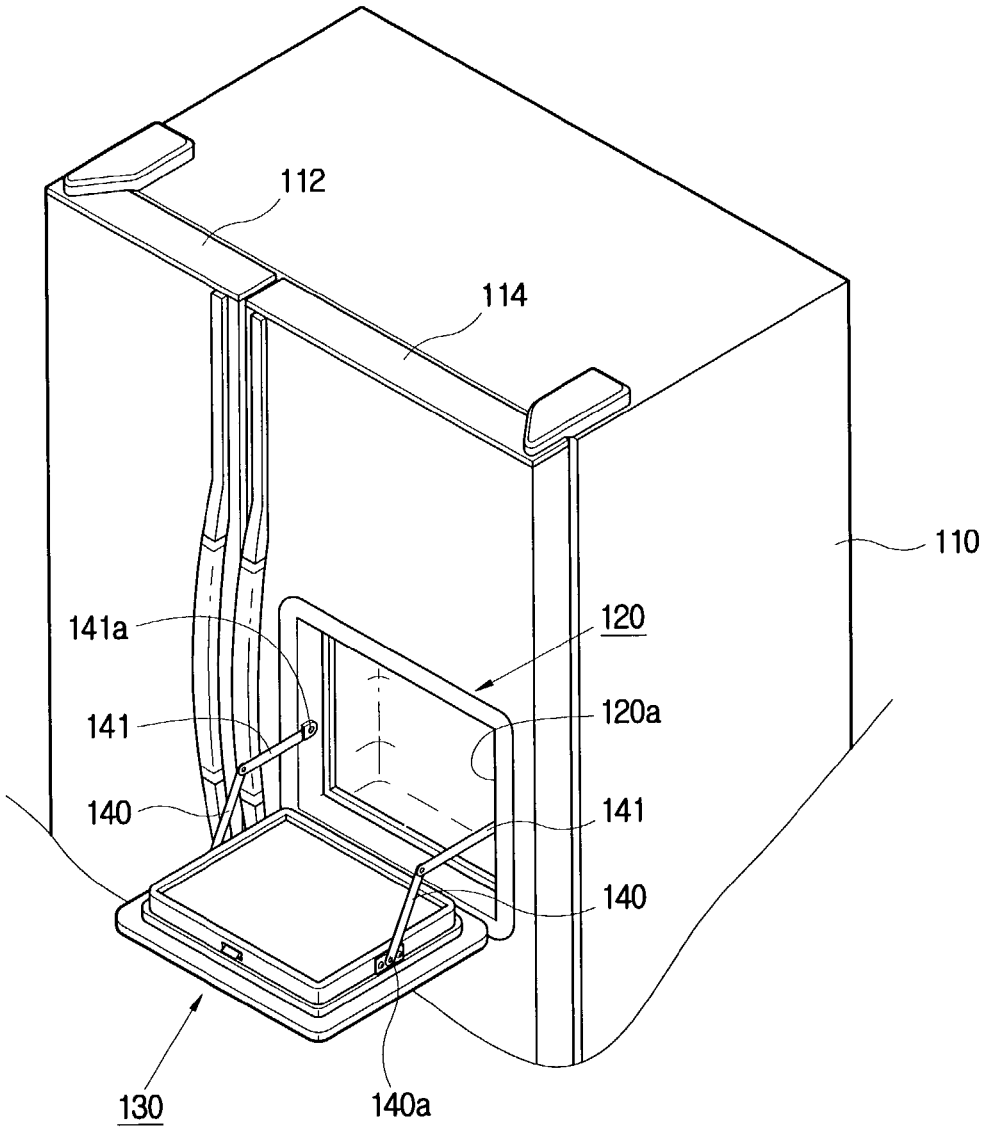
FIG. 6 (PRIOR ART)
FIGS. 6 and 7 are perspective views of conventional refrigerators, respectively.
Figure 7:
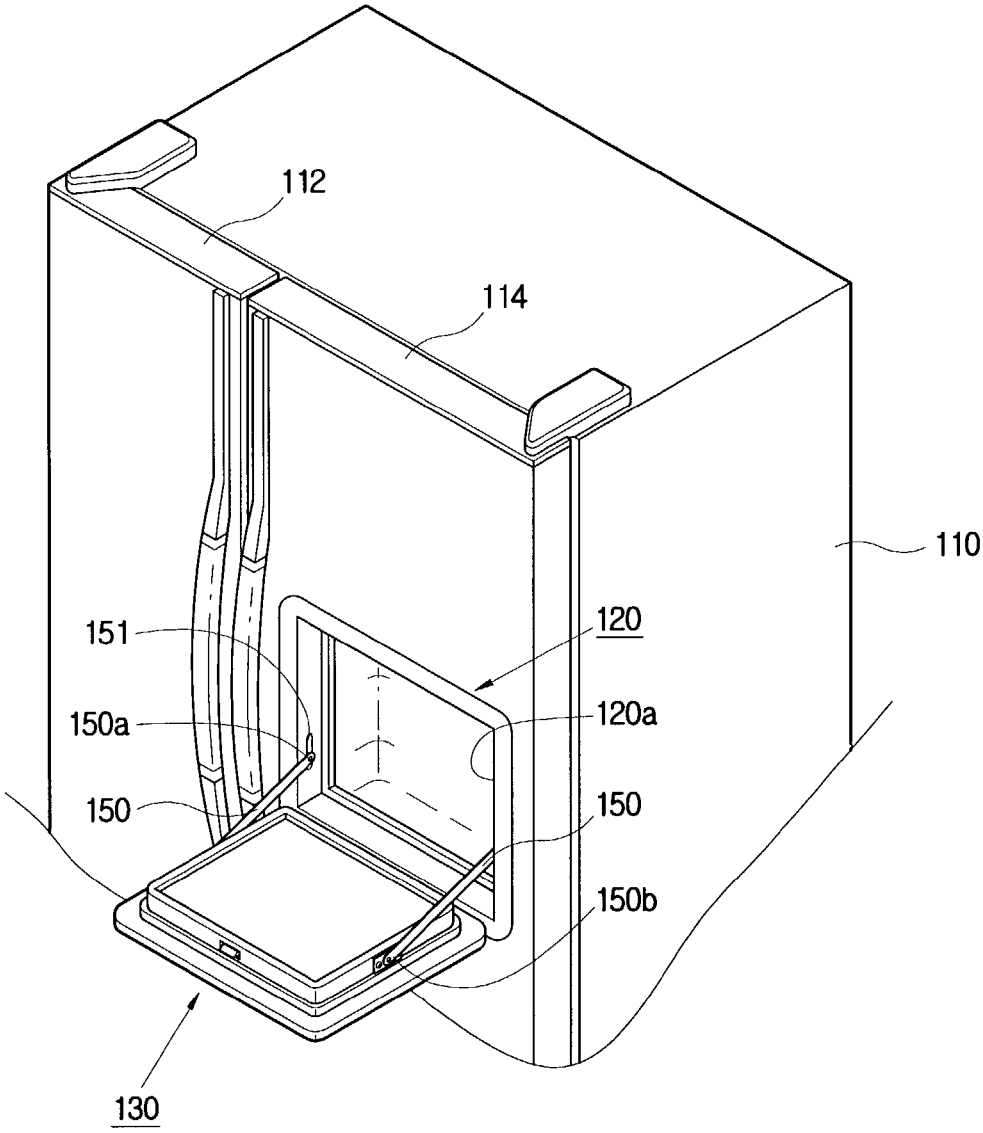
FIG. 7 (PRIOR ART)

As described above, according to the present invention, in the home bar unit door 30 and the opening 20*a* of the home bar unit 20, provided on the movable bracket 40 and the support bracket 50 are the first and second stoppers 45 and 55, respectively, to accomplish the rotation of the home bar unit door 30. Therefore, not only the opposite sides of the home bar door 30 are prevented from being blocked by any links when the home bar door unit 30 is opened, but also the appearance thereof becomes tidy by removing the links (see 140, 141 and 150 in FIGS. 6 and 7) according to the conventional refrigerator.

In the above description, in the opening 20*a* of the home bar unit 20 is provided the supporting frame 16. However, in the alternative, a supporting frame may not be provided in the opening 20*a*.

As described above, the present invention provides a refrigerator in which opposite sides of a home bar unit door are not blocked by any links when the home bar unit door is opened, and the appearance thereof is tidy.

Although a few embodiments of the present invention have been shown and described, it would be appreciated by those skilled in the art that changes may be made in this embodiment without departing from the principles and spirit of the invention, the scope of which is defined in the claims and their equivalent.

What is claimed is:

1. A refrigerator having a door to open and close a refrigerator compartment, a home bar unit provided on the door and having an opening through which the refrigerator compartment communicates with the outside, and a home bar unit door opening and closing the opening of the home bar unit, further comprising:

a support bracket connected to the opening of the home bar unit;

a movable bracket connected to the home bar unit door and rotating together with the home bar unit door; and a stopper unit including a first stopper provided at the movable bracket and rotating together with the movable bracket, and a second stopper provided at the support bracket and restricting the rotation of the home bar unit door by supporting the first stopper when the home bar unit door is positioned at an open position thereof, wherein the first stopper is located along a lower edge of the home bar unit door closest to an axis of rotation of the home bar unit door, and the second stopper is located along a lower edge of the opening of the home bar unit closest to the axis of rotation of the home bar unit door, wherein the home bar unit comprises:

a front cover on the exterior of the home bar unit door; and a rear cover on the inside portion of the home bar unit door such that the first stopper is provided on the rear cover, wherein the movable bracket comprises:

a pair of first brackets spaced from each other at a predetermined distance and connected to the rear of the home bar unit door; and a second bracket being connected to the first stopper.

2. The refrigerator according to claim 1, wherein the first stopper comprises:

a first extension part curvedly extending from the second bracket; and a second extension part bending angularly from the first extension part.

3. The refrigerator according to claim 2:

wherein the home bar unit door comprises a pair of hinge pins at lower opposite sides thereof about which the home bar unit door rotates, and the movable bracket comprises a first flange having a first hinge hole rotatably connected to one of said pair of hinge pins.

4. The refrigerator according to claim 3, wherein the support bracket comprises:

a pair of third brackets connected to the rear opposite sides of the opening of the home bar unit; and a fourth bracket connecting the third brackets, the fourth bracket having the second stopper connected thereto.

5. The refrigerator according to claim 4, wherein the second stopper comprises:

a horizontal extension part extending from the fourth bracket and contacting the first stopper when the home bar unit door is opened; and a vertical extension part downwardly bending from the horizontal extension part and buried within a wall of the opening of the home bar unit.

6. The refrigerator according to claim 5, wherein the vertical extension part is disposed inside the refrigerator door and fixed by a foaming agent filled within the refrigerator door.

7. The refrigerator according to claim 4:

wherein the support bracket further comprises a second flange having a second hinge hole therein in cooperation with the first hinge hole and rotatably connected to one of the pair of hinge pins.

8. The refrigerator according to claim 1, wherein the first brackets, the second bracket and the first stopper are formed as one body and of one material.

9. A refrigerator having a door to open and close a refrigerator compartment, a home bar unit provided on the door and having an opening through which the refrigerator compartment communicates with the outside, and a home bar unit door opening and closing the opening of the home bar unit, further comprising:

a support bracket connected to the opening of the home bar unit;

a movable bracket connected to the home bar unit door and rotating together with the home bar unit door; and a stopper unit including a first stopper provided at the movable bracket and rotating together with the movable bracket, and a second stopper provided at the support bracket and restricting the rotation of the home bar unit door by supporting the first stopper when the home bar unit door is positioned at an open position thereof, wherein the first stopper is located along a lower edge of the home bar unit door closest to an axis of rotation of the home bar unit door, and the second stopper is located along a lower edge of the opening of the home bar unit closest to the axis of rotation of the home bar unit door, wherein the home bar unit comprises:

a front cover on the exterior of the home bar unit door; and a rear cover on the inside portion of the home bar unit door such that the first stopper is provided on the rear cover, wherein the support bracket comprises:

a pair of brackets connected to the rear opposite sides of the opening of the home bar unit; and another bracket having the second stopper connected thereto, and wherein the second stopper comprises:

a horizontal extension part extending from the another bracket and contacting the first stopper when the home bar unit door is opened; and a vertical extension part downwardly bending from the horizontal extension part and buried within a wall of the opening of the home bar unit.

10. A refrigerator having a door to open and close a refrigerator compartment, a home bar unit provided on the door and having an opening through which the refrigerator compartment communicates with the outside, and a home bar unit door opening and closing the opening of the home bar unit, further comprising:

a support bracket connected to the opening of the home bar unit;

a movable bracket connected to the home bar unit door and rotating together with the home bar unit door; and a stopper unit including a first stopper provided at the movable bracket and rotating together with the movable bracket, and a second stopper provided at the support bracket and restricting the rotation of the home bar unit door by supporting the first stopper when the home bar unit door is positioned at an open position thereof, wherein the first stopper is located along a lower edge of the home bar unit door closest to an axis of rotation of the home bar unit door, and the second stopper is located along a lower edge of the opening of the home bar unit closest to the axis of rotation of the home bar unit door, wherein the home bar unit comprises:

a front cover on the exterior of the home bar unit door; and a rear cover on the inside portion of the home bar unit door such that the first stopper is provided on the rear cover, wherein the support bracket comprises:

a pair of brackets connected to the rear opposite sides of the opening of the home bar unit; and another bracket having the second stopper connected thereto, and wherein the home bar unit door comprises a pair of hinge pins at lower opposite sides thereof about which the home bar unit door rotates;

the movable bracket comprises a first flange having a first hinge hole rotatably connected to one of the pair of hinge pins; and wherein the support bracket further comprises a second flange having a second hinge hole therein in cooperation with the first hinge hole and rotatably connected to one of the pair of hinge pins.

11. A refrigerator having a front door with a home bar unit including a home bar unit door provided thereon to expose the inside of the refrigerator externally thereof without opening the front door, the home bar unit comprising:

a supporting frame affixed to the front door;

a support bracket connected to the inside of the supporting frame; and a movable bracket connected to the bottom of the home bar unit door such that when the home bar unit door rotates to a fully open position the movable bracket is supported by the support bracket to stop the rotation thereof, wherein the home bar unit door comprises a pair of hinge pins at lower opposite sides thereof about which the home bar unit door rotates;

the movable bracket comprises a first flange having a first hinge hole rotatably connected to one of the pair of hinge pins; and wherein the support bracket further comprises a second flange having a second hinge hole therein in cooperation with the first hinge hole and rotatably connected to one of the pair of hinge pins, wherein the movable bracket further comprises a first stopper extending past the bottom of the home bar unit door, wherein the support bracket further comprises:

a second stopper to contact the first stopper and stop the rotation of the home bar unit door when the home bar unit door has rotated to the fully open position, and wherein the second stopper comprises:

a horizontal extension part extending from the second stopper to block the rotation of the first stopper.

12. A refrigerator having a front door with a home bar unit including a home bar unit door provided thereon to expose the inside of the refrigerator externally thereof without opening the front door, the home bar unit comprising:

a supporting frame affixed to the front door;

a support bracket connected to the inside of the supporting frame; and a movable bracket connected to the bottom of the home bar unit door such that when the home bar unit door rotates to a fully open position the movable bracket is supported by the support bracket to stop the rotation thereof, wherein the home bar unit door comprises a pair of hinge pins at lower opposite sides thereof about which the home bar unit door rotates;

the movable bracket comprises a first flange having a first hinge hole rotatably connected to one of the pair of hinge pins; and wherein the support bracket further comprises a second flange having a second hinge hole therein in cooperation with the first hinge hole and rotatably connected to one of the pair of hinge pins, wherein the home bar unit door further comprises:

a lever unit positioned within the home bar unit door to release the home bar unit door from the refrigerator door, the lever unit having a pair of lever hinge pins providing an axis of rotation of the lever unit to rotate the lever unit between a locked position and a released position to lock and release the home bar unit door to and from the refrigerator door.

13. The refrigerator according to claim 12, wherein the lever unit further comprises a hook extending therefrom to engage the supporting frame and lock the home bar unit door in a closed position with respect to the refrigerator door.

* * * * *